US010340642B2

(12) United States Patent
Honda et al.

(10) Patent No.: US 10,340,642 B2
(45) Date of Patent: Jul. 2, 2019

(54) FUSE-EQUIPPED HERMETIC TERMINAL

(71) Applicant: SCHOTT Japan Corporation, Koka-shi, Shiga (JP)

(72) Inventors: Hiroki Honda, Koka (JP); Hidehiko Harada, Koka (JP); Yusuke Maegawa, Koka (JP); Tokihiro Yoshikawa, Koka (JP)

(73) Assignee: SCHOTT Japan Corporation, Koka-shi, Shiga (JP)

( * ) Notice: Subject to any disclaimer, the term of this patent is extended or adjusted under 35 U.S.C. 154(b) by 0 days.

(21) Appl. No.: 15/740,155

(22) PCT Filed: Jul. 1, 2016

(86) PCT No.: PCT/JP2016/069701
§ 371 (c)(1),
(2) Date: Dec. 27, 2017

(87) PCT Pub. No.: WO2017/006881
PCT Pub. Date: Jan. 12, 2017

(65) Prior Publication Data

US 2018/0198243 A1 Jul. 12, 2018

(30) Foreign Application Priority Data

Jul. 6, 2015 (JP) ..... 2015-134889

(51) Int. Cl.
*H01B 17/30* (2006.01)
*H01R 13/684* (2011.01)
(Continued)

(52) U.S. Cl.
CPC ..... *H01R 13/684* (2013.01); *H01H 1/023* (2013.01); *H01H 1/025* (2013.01);
(Continued)

(58) Field of Classification Search
CPC ..... H01B 17/30; H01B 17/265; H01R 13/68; H01R 13/02
(Continued)

(56) References Cited

U.S. PATENT DOCUMENTS 4,252,394 A 2/1981 Miller
4,461,925 A * 7/1984 Bowsky ..... H01B 17/305 174/152 GM
(Continued)

FOREIGN PATENT DOCUMENTS

CN 87104894 A 1/1988
CN 102047367 A 5/2011
(Continued)

OTHER PUBLICATIONS

PCT International Search Report of the International Searching Authority for International Application PCT/JP2016/069701, dated Oct. 4, 2016, 1 page, Japanese Patent Office, Tokyo, Japan.
(Continued)

*Primary Examiner* — Hien D Vu
(74) *Attorney, Agent, or Firm* — W. F. Fasse

(57) ABSTRACT

A fuse-equipped hermetic terminal includes: a housing provided with a hollow portion and a pair of through holes located with the hollow portion being interposed therebetween; a conductive pin extending through the housing via the pair of through holes and the hollow portion; and a pair of insulating sealing materials that each hermetically seal a gap between the conductive pin and a corresponding one of the pair of through holes. Each of the conductive pins includes an inner pin, an outer pin, and a fuse element that bridges between the inner pin and the outer pin and that is located in the hollow portion.

12 Claims, 3 Drawing Sheets

(51) Int. Cl.

| | |
|---|---|
| ***H01R 9/16*** | (2006.01) |
| ***H01R 13/696*** | (2011.01) |
| ***H01H 1/023*** | (2006.01) |
| ***H01H 1/025*** | (2006.01) |
| ***H01H 85/02*** | (2006.01) |
| ***H01R 13/04*** | (2006.01) |
| ***H01R 13/52*** | (2006.01) |
| *H01H 85/20* | (2006.01) |

(52) U.S. Cl.
CPC ..... *H01H 85/0241* (2013.01); *H01R 9/16* (2013.01); *H01R 13/04* (2013.01); *H01R 13/5219* (2013.01); *H01R 13/696* (2013.01); *H01H 85/20* (2013.01)

(58) Field of Classification Search
USPC ..... 174/152 GM, 50.52
See application file for complete search history.

(56) References Cited

U.S. PATENT DOCUMENTS

| | | | | |
|---|---|---|---|---|
| 4,584,433 | A | 4/1986 | Bowsky et al. | |
| 4,609,774 | A | 9/1986 | LeMieux et al. | |
| 4,739,551 | A | 4/1988 | Bowsky et al. | |
| 4,830,630 | A * | 5/1989 | Dozier | H01H 85/201 174/152 GM |
| 4,964,788 | A * | 10/1990 | Itameri-Kinter | H01R 13/74 174/152 GM |
| 5,017,740 | A * | 5/1991 | Honkomp | H01B 17/305 174/138 F |
| 5,471,015 | A | 11/1995 | Paterek et al. | |
| 5,493,073 | A * | 2/1996 | Honkomp | H01B 17/305 174/152 GM |
| 6,274,252 | B1 * | 8/2001 | Naugler | C03C 27/02 174/152 GM |
| 7,046,499 | B1 * | 5/2006 | Imani | H01G 4/35 174/152 GM |
| 7,745,725 | B2 * | 6/2010 | Paterek | F04C 23/008 174/152 GM |
| 2011/0095860 | A1 | 4/2011 | Higashikata | |

FOREIGN PATENT DOCUMENTS

| | | |
|---|---|---|
| EP | 0 184 538 | 6/1991 |
| EP | 0 447 607 | 9/1991 |
| JP | 61-135074 A | 6/1986 |
| JP | 63-021774 A | 1/1988 |
| JP | 06-060928 A | 3/1994 |
| JP | 2013-140746 A | 7/2013 |

OTHER PUBLICATIONS

PCT Examiner Yukari Nakamura, PCT International Preliminary Report on Patentability including English Translation of PCT Written Opinion of the International Searching Authority for International Application PCT/JP2016/069701, dated Jan. 9, 2018, 6 pages, International Bureau of WIPO, Geneva, Switzerland.

Chinese Office Action in Chinese Patent Application No. 201680039543.1, dated Nov. 28, 2018, 6 pages, with partial English translation, 4 pages.

Extended European Search Report and Examination Report for European Patent Application No. 16821350.2, dated Jan. 22, 2019, 7 pages, European Patent Office, Munich, Germany.

* cited by examiner

FUSE-EQUIPPED HERMETIC TERMINAL

TECHNICAL FIELD

The present invention relates to a fuse-equipped hermetic terminal.

BACKGROUND ART

A hermetic terminal has been used which is configured to be fixable to a mounting hole provided in a hermetic container in order to supply a signal or power to an electric device contained in the hermetic container. For example, in a compressor used for an air conditioner, refrigerator, or the like, power is supplied from a power supply to a motor in a container of a motor unit via a hermetic terminal hermetically fixed to the container.

Since a compressor such as that in the air conditioner or refrigerator has a motor therein, electrically conductive particles resulting from wear of a sliding portion such as a bearing are gradually accumulated in refrigerant and refrigerator oil. When these electrically conductive particles are adhered to a surface of a glass insulatively sealing a metal stem and an electrode rod of the hermetic terminal, an insulation resistance between the metal stem and the electrode rod is decreased gradually, which may result in a short circuit in an extreme case.

When such a short circuit occurs between the metal stem and the electrode rod, overcurrent may flow to increase temperature and accordingly melt the sealing glass, with the result that the electrode rod may be removed from the metal stem and the oil in the compressor may leak to outside. In order to prevent such a phenomenon, a hermetic terminal with a fuse region has been conventionally used. The hermetic terminal has a conductive pin provided with a portion that generates heat when supplied with power. When overcurrent flows, the heat generating portion is melted and disconnected, thus interrupting supply of power to the motor.

For example, a hermetic terminal described in Patent Document 1 is provided with a fuse region constituted of a neck portion having a small cross sectional area at an axial intermediate portion of a conductive pin of the hermetic terminal. Since the conductive pin itself has a current fuse function, the fuse region is melted and disconnected when overcurrent is applied thereto, thereby interrupting supply of power. In this way, the motor is prevented from being burned out.

In Patent Document 2, a pin material is roll-formed to provide a fuse region in a conductive pin. By the roll forming, a flange is formed in the pin material, thereby forming a small-diameter groove that defines the fuse region.

However, in each of the conventional hermetic terminals with the fuse regions, a portion of the conductive pin is formed to have a small diameter, thereby forming the fuse region having a small conductive capacity. When overcurrent is applied, this fuse region is heated to be red hot due to resistance heating, is then melted, and is disconnected. Therefore, in each of the conventional hermetic terminals with the fuse regions, it takes a long time until the conductive pin, which is composed of a steel material or copper material, is heated to be red hot and is disconnected due to the overcurrent. Moreover, the melting/disconnection temperature is also high to be more than 1000° C. Moreover, the fuse region of the conductive pin may not be disconnected as intended. Actually, a portion of connection of the conductive pin with an interconnection may be disconnected first. Thus, the disconnection does not always take place at the same portion, disadvantageously.

Further, when it takes a certain time or more for the fuse to be melted and disconnected, the glass serving as the insulating sealing material near the fuse region may be melted first, with the result that the conductive pin may be removed due to refrigerant internal pressure. To address this, in the hermetic terminal of Patent Document 2, the flange is provided in the conductive pin to prevent the removal of the conductive pin.

In the hermetic terminal of Patent Document 3, a high melting point glass material is used for the insulating sealing material. This makes it difficult to melt the insulating sealing material. However, use of such a special high melting point glass material leads to increased material cost. Moreover, an operation temperature in the glass sealing step needs to be changed to a higher temperature. These are not necessarily preferable in terms of product cost and production energy efficiency.

CITATION LIST

Patent Document

PTD1: Japanese Patent Laying-Open No. 61-135074
PTD2: Japanese Patent Laying-Open No. 63-021774
PTD3: Japanese Patent Laying-Open No. 06-060928

SUMMARY OF INVENTION

Technical Problem

An object of the present invention is to provide a fuse-equipped hermetic terminal with improved safety.

Solution to Problem

In accordance with a fuse-equipped hermetic terminal according to one embodiment of the present invention, the fuse-equipped hermetic terminal includes: a housing provided with a hollow portion and a pair of through holes located with the hollow portion being interposed therebetween; a conductive pin extending through the housing via the pair of through holes and the hollow portion; and a pair of insulating sealing materials that each hermetically seal a gap between the conductive pin and a corresponding one of the pair of through holes. The conductive pin includes an inner pin, an outer pin, and a fuse element that bridges between the inner pin and the outer pin and that is located in the hollow portion.

In the fuse-equipped hermetic terminal, the housing may include a first eyelet and a second eyelet, at least a portion of the hollow portion being provided in the first eyelet, the second eyelet being sealed with the first eyelet. The first eyelet may be provided with one of the pair of through holes, and the second eyelet may be provided with the other of the pair of through holes.

In the fuse-equipped hermetic terminal, a portion of the hollow portion may be provided in the first eyelet, and another portion of the hollow portion may be provided in the second eyelet.

In the fuse-equipped hermetic terminal, at least a portion of the conductive pin may be constituted of a composite metal member including a core member and a jacket member.

In the fuse-equipped hermetic terminal, the core member may be composed of a fusible metal material, and the fuse element of the conductive pin may be constituted of the core member exposed through the jacket member.

In the fuse-equipped hermetic terminal, electric resistances of the outer pin and the inner pin may be different from each other.

In the fuse-equipped hermetic terminal, center axes of the pair of through holes may be deviated from each other.

In the fuse-equipped hermetic terminal, the fuse element may be composed of a fusible metal material selected from a group consisting of a solder alloy, copper, a copper alloy, aluminum, an aluminum alloy, silver, and a silver alloy.

Advantageous Effects of Invention

According to the fuse-equipped hermetic terminal according to one embodiment of the present invention, there can be provided a fuse-equipped hermetic terminal with improved safety.

DESCRIPTION OF EMBODIMENTS

A fuse-equipped hermetic terminal according to one embodiment of the present invention includes: a housing provided with a hollow portion and a pair of through holes located with the hollow portion being interposed therebetween; a conductive pin extending through the housing via the pair of through holes and the hollow portion; and a pair of insulating sealing materials that each hermetically seal a gap between the conductive pin and a corresponding one of the pair of through holes. Each conductive pin includes an inner pin, an outer pin, and a fuse element that bridges between the inner pin and the outer pin and that is located in the hollow portion.

Figure 1:
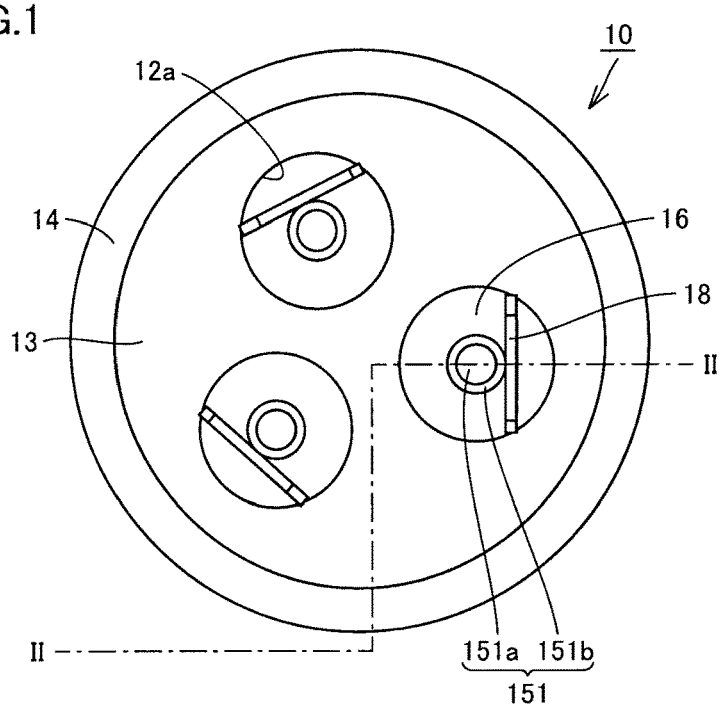
FIG. 1 is a plan view showing a fuse-equipped hermetic terminal according to a first embodiment of the present invention.
Figure 2:
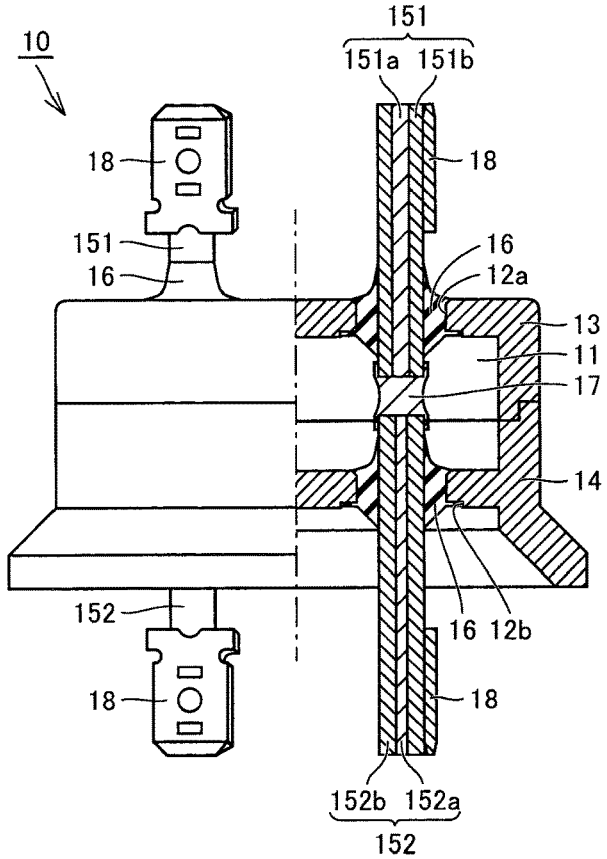
FIG. 2 is a partial cross sectional view showing a front portion of the fuse-equipped hermetic terminal according to the first embodiment of the present invention along an II-II line of FIG. 1.
Figure 3:
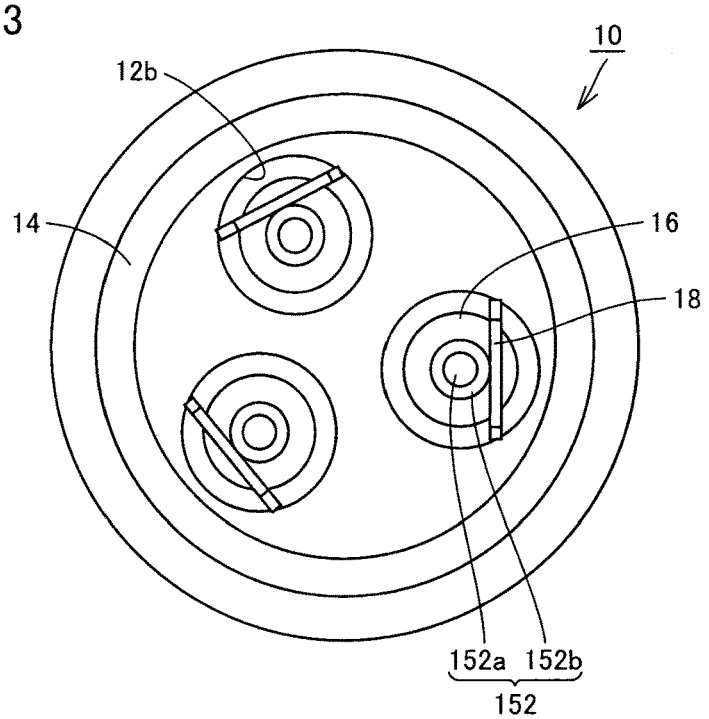
FIG. 3 is a bottom view showing the fuse-equipped hermetic terminal according to the first embodiment of the present invention.

For example, a hermetic terminal 10 shown in FIG. 1 to FIG. 3 includes a first eyelet 13, a second eyelet 14, conductive pins, and insulating sealing materials 16. In the first eyelet, a portion of a hollow portion 11 is provided. The first eyelet is provided with three through holes 12*a*. Second eyelet 14 is engaged with first eyelet 13 to form a housing and is provided with three through holes 12*b*. The conductive pins extend to the inner and outer sides of the housing with the conductive pins being in through holes 12*a* of first eyelet 13 and through holes 12*b* of second eyelet 14. Insulating sealing materials 16 hermetically seal the conductive pins in first eyelet 13 and second eyelet 14. Each of the conductive pins has an outer pin 151, an inner pin 152, and a fuse element 17 that bridges between outer pin 151 and inner pin 152. Fuse element 17 is accommodated in the housing. Hollow portion 11 is provided in at least one of first eyelet 13 and second eyelet 14, but may be provided in both of the eyelets as shown in FIG. 2.

Fuse element 17 is not limited particularly as long as fuse element 17 is composed of a fusible metal material. Suitable examples of fuse element 17 include a solder alloy, copper, a copper alloy, aluminum, an aluminum alloy, silver, a silver alloy, and the like. For each of first eyelet 13 and second eyelet 14, a Fe-based metal material is suitable, such as carbon steel, stainless steel, or a Fe—Ni alloy.

For each of outer pin 151 and inner pin 152 of the conductive pin, an alloy such as a Fe—Cr alloy or a Fe—Ni alloy is suitable. When outer pin 151 and inner pin 152 are respectively constituted of composite metal members including core members and jacket members 151*b*, 152*b* that cover core members 151*a*, 152*a*, it is suitable to employ copper for core members 151*a*, 152*a*, and employ a steel material, a Fe—Cr alloy, a Fe—Ni alloy, or the like for jacket members 151*b*, 152*b*.

Insulating sealing material 16, which hermetically seals the conductive pin in first eyelet 13 or second eyelet 14, is not limited particularly as long as insulating sealing material 16 is a heat-resistant insulating material. Suitable examples of insulating sealing material 16 include: glass materials such as soda lime glass, soda barium glass, and borosilicate glass; and thermosetting resins such as an epoxy resin.

In the fuse-equipped hermetic terminal, a conductive pin having a fuse element built therein may be employed. Specifically, each of outer pin 151 and inner pin 152 of the conductive pin is constituted of a core member composed of a fusible metal; and a jacket member that covers a surface thereof. The fuse element may be obtained by exposing the core member therethrough at a predetermined portion and this fuse element may be accommodated in the housing.

In the fuse-equipped hermetic terminal according to one embodiment, fuse element 17 provided in the conductive pin is provided inside the housing. Fuse element 17 is melted and disconnected in response to extraordinary overheating or overcurrent, thereby interrupting the power supply circuit immediately. Since fuse element 17 is immediately disconnected, insulating sealing material 16 that seals the conductive pin can be prevented from being melted and removed without using a high melting point glass for insulating sealing material 16. Since fuse element 17, which is operable to be melted and disconnected, is disposed in the housing, fuse element 17 can be retained with external air or moisture being prevented from entering. Moreover, the melted and disconnected portion can be limited to be in the housing, thereby providing safety.

Outer pin 151 and inner pin 152 both included in the conductive pin can have configurations different from each other. For example, the outer pin and the inner pin can have electric resistances different from each other. When the electric resistance value of the outer pin<the electric resistance value of the inner pin, an amount of heat due to supplied power at the inner pin 152 side can be always larger than that at the outer pin 151 side. Accordingly, insulating sealing material 16 can be melted and removed only at the inner pin 152 side. Even when the melting and removal takes place at the inner pin 152 side, hermeticity in the container having hermetic terminal 10 attached thereto is not compromised because hermetic terminal 10 has a double structure (double sealing structure). As a result, an interconnection portion is avoided from being removed out of the container and the terminal pin, refrigerant, and oils and fats are avoided from being pushed to outside due to internal pressure, thus providing safety.

In the present specification, the outer pin refers to a pin that is disposed at an outer side of the container to which the fuse-equipped hermetic terminal is attached and that is connected to an external device such as a power supply device. The inner pin refers to a pin connected to an internal device, such as a motor or a control device, disposed in the container to which the hermetic terminal is attached. It should be noted that the housing included in hermetic terminal 10 differs from the above-mentioned container.

First Embodiment

As shown in FIG. 1 to FIG. 3, fuse-equipped hermetic terminal 10 of the first embodiment is a hermetic terminal having an eyelet provided with a flange to be fixable to a mounting hole provided in a container of a motor unit of a compressor.

Hermetic terminal 10 includes first eyelet 13, second eyelet 14, the conductive pins, and insulating sealing materials 16. First eyelet 13 is provided with hollow portion 11 and three through holes 12*a*, and is composed of carbon steel. Second eyelet 14 is provided with three through holes 12*b* and is joined to first eyelet 13 to form the housing. Through holes 12*a* and through holes 12*b* are located with hollow portion 11 being interposed therebetween. The number of through holes 12*a*, 12*b* may be one or two, and may be more than or equal to four.

Each of the conductive pins includes: outer pin 151 extending through through hole 12*a*; and inner pin 152 extending through through hole 12*b*. The conductive pin extends to the inner and outer sides of the housing. Insulating sealing materials 16 hermetically seal outer pin 151 in first eyelet 13 and hermetically seal inner pin 152 in second eyelet 14. Insulating sealing material 16 is composed of borosilicate glass. Fuse element 17, which is composed of a fusible metal material, bridges between outer pin 151 and inner pin 152. Fuse element 17 is accommodated in the housing.

Hollow portion 11 is formed in each of first eyelet 13 and second eyelet 14 as shown in FIG. 2. First eyelet 13 and second eyelet 14 are sealed with each other at the outer circumferential portion, thus securing the hermeticity of hollow portion 11. Specifically, a rib is provided at the inner circumferential side of the tip of the outer circumferential wall of first eyelet 13, whereas a rib is provided at the outer circumferential side of the tip of the outer circumferential wall of second eyelet 14. By engaging the tip of the outer circumferential wall of first eyelet 13 with the tip of the outer circumferential wall of the second eyelet, hermeticity is secured. The shape for securing the hermeticity is not limited to this, and various configurations can be employed.

The conductive pin is constituted of one pair of outer pin 151 sealed in first eyelet 13 and inner pin 152 sealed in second eyelet 14. Outer pin 151 and inner pin 152 are electrically connected via fuse element 17 disposed in the hermetic housing.

For outer pin 151 and inner pin 152, composite metal pins are used which respectively include: copper core members 151*a*, 152*a* and jacket members 151*b*, 152*b* composed of a Fe—Cr alloy. The diameter of the copper core of outer pin 151 sealed in first eyelet 13 is made thick, whereas the diameter of the copper core of inner pin 152 sealed in second eyelet 14 is made thin. This leads to the electric resistance value of the outer pin<the electric resistance value of the inner pin, whereby the amount of heat due to supplied power at the inner pin side becomes larger than that at the outer pin side. Accordingly, even if insulating sealing material 16 is melted, the timing of the melting of the insulating sealing material at the inner pin side always comes first. Accordingly, removal of the sealing can be kept in the case.

Outer pin 151 and inner pin 152 can have the same structure. Each of outer pin 151 and inner pin 152 can be constituted of a single metal member, rather than the composite metal member.

In the present embodiment, core members 151*a*, 152*a* can be composed of a material different from that of fuse element 17. Likewise, jacket members 151*b*, 152*b* can be composed of a material different from that of fuse element 17.

Even when insulating sealing material 16 is melted at the inner pin side, hermeticity in the container having hermetic terminal 10 attached thereto is not compromised because hermetic terminal 10 has a double structure (double sealing structure). Accordingly, an interconnection cord and the conductive pin can be avoided from being removed out of the container together with the refrigerant and oils and fats, thus providing safety. A terminal plate 18 for connection with an interconnection as shown in FIG. 1 to FIG. 3 may be joined to a side surface of an end portion of the conductive pin.

Second Embodiment

A fuse-equipped hermetic terminal 20 of a second embodiment is a modification of fuse-equipped hermetic terminal 10 described above. The position of the center axis of through hole 12*a* of first eyelet 13 is deviated from the position of the center axis of through hole 12*b* of second eyelet 14, thereby preventing sealed outer pin 251 and inner pin 252 from hitting each other.

Figure 4:
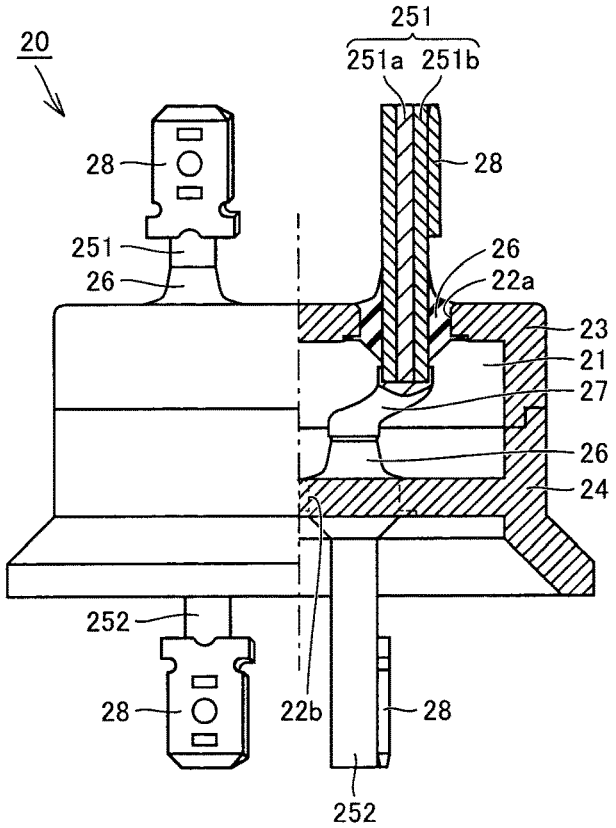
FIG. 4 is a partial cross sectional view showing a front portion of a fuse-equipped hermetic terminal according to a second embodiment of the present invention at a position corresponding to the II-II line of FIG. 1.

As shown in FIG. 4, hermetic terminal 20 includes a first eyelet 23, a second eyelet 24, conductive pins, and insulating sealing materials 26. First eyelet 23 is provided with a hollow portion 21 and three through holes 22*a*, and is composed of carbon steel. Second eyelet 24 is provided with three through holes 22*b* and is joined to first eyelet 23 to form a housing. Through holes 22*a* and through holes 22*b* are located with hollow portion 21 being interposed therebetween.

Each of the conductive pins includes: an outer pin 251 extending through through hole 22*a*; and inner pin 252 extending through through hole 22*b*. The conductive pin extends to the inner and outer sides of the housing. Insulating sealing materials 26 hermetically seal outer pin 251 in first eyelet 23 and hermetically seal inner pin 252 in second eyelet 24. Insulating sealing material 26 is composed of soda barium glass. Fuse element 27, which is composed of a fusible metal material, bridges between outer pin 251 and inner pin 252. Fuse element 27 is accommodated in the housing.

Hollow portion 21 is formed in each of first eyelet 23 and second eyelet 24 as shown in FIG. 4. The conductive pin is constituted of one pair of outer pin 251 sealed in first eyelet 23 and inner pin 252 sealed in second eyelet 24. Outer pin 251 and inner pin 252 are electrically connected via fuse element 27 disposed in the hermetic housing.

For outer pin 251 and inner pin 252, composite metal pins are used which include: copper core members 251*a*, 252*a* and jacket members 251*b*, 252*b* composed of a Fe—Cr alloy. The diameter of the copper core of outer pin 251 sealed in first eyelet 23 is made thick, whereas the diameter of the copper core of inner pin 252 sealed in second eyelet 24 is made thin. This leads to the electric resistance value of the outer pin<the electric resistance value of the inner pin, whereby the amount of heat due to supplied power at the inner pin side becomes larger than that at the outer pin side. Accordingly, even if insulating sealing material 26 is melted, the timing of the melting of the insulating sealing material at the inner pin side always comes first. Accordingly, removal of the sealing can be kept in the case.

The center axis of through hole 22*a* of first eyelet 23 is deviated from the center axis of through hole 22*b* of second eyelet 24 in the rotation direction of each of first eyelet 23 and second eyelet 24. The center axis of through hole 22*a* of first eyelet 23 may be deviated from the center axis of through hole 22*b* of second eyelet 24 in the radial direction of each of first eyelet 23 and second eyelet 24.

The axis of outer pin 251 extending through through hole 22*a* of first eyelet 23 is deviated from the axis of inner pin 252 extending through through hole 22*b* of second eyelet 24, whereby outer pin 251 does not overlap with inner pin 252 in the upward/downward direction. Specifically, through hole 22*a* of the first eyelet is deviated from through hole 22*b* of the second eyelet by 60° in the rotation direction. Accordingly, even when the melting and removal take place at the inner pin 252 side, inner pin 252, which is pushed up, is not brought into contact with outer pin 251. In this way, inner pin 252 and outer pin 251 can be prevented from being electrically connected to each other again.

Even when insulating sealing material 26 is melted at the inner pin side, hermeticity in the container having hermetic terminal 20 attached thereto is not compromised because hermetic terminal 20 has a double structure (double sealing structure). Accordingly, an interconnection cord and the conductive pin can be avoided from being removed out of the container together with the refrigerant and oils and fats, thus providing safety. A terminal plate 28 for connection with an interconnection as shown in FIG. 4 may be joined to a side surface of an end portion of the conductive pin.

Third Embodiment

A fuse-equipped hermetic terminal 30 of a third embodiment employs a conductive pin having a fuse element built therein.

Figure 5:
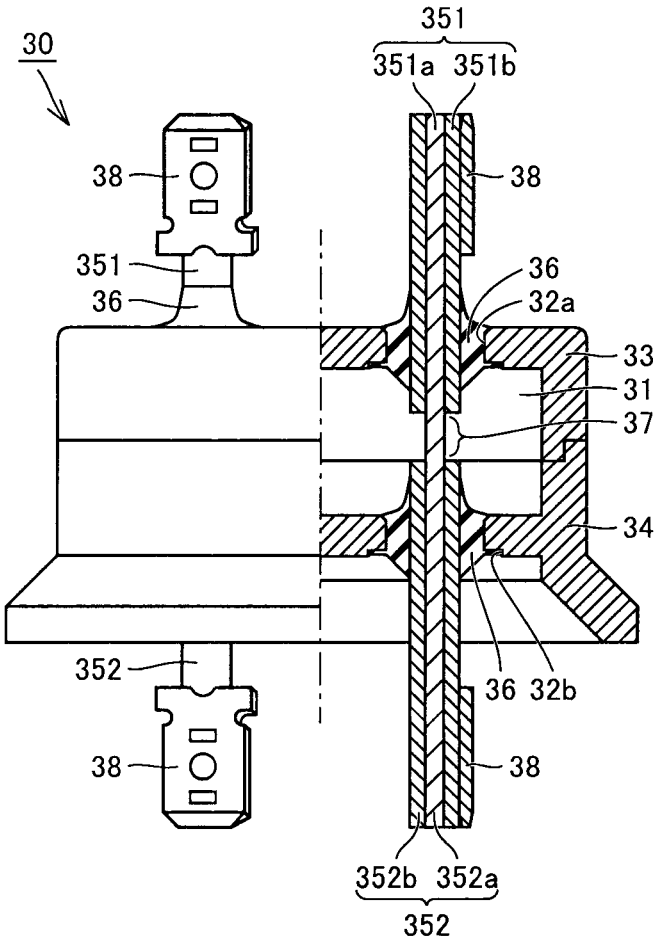
FIG. 5 is a partial cross sectional view showing a front portion of a fuse-equipped hermetic terminal according to a third embodiment of the present invention at the position corresponding to the II-II line of FIG. 1.

As shown in FIG. 5, hermetic terminal 30 includes a first eyelet 33, a second eyelet 34, conductive pins, and insulating sealing materials 36. First eyelet 33 is provided with hollow portion 31 and three through holes 32*a*, and is composed of carbon steel. Second eyelet 34 is provided with three through holes 32*b* and is joined to first eyelet 33 to form the housing. Through holes 32*a* and through holes 32*b* are located with hollow portion 31 being interposed therebetween.

Each of the conductive pins includes: outer pin 351 extending through through hole 32*a*; and inner pin 352 extending through through hole 32*b*. The conductive pin extends to the inner and outer sides of the housing. Insulating sealing materials 36 hermetically seal outer pin 351 in first eyelet 33 and hermetically seal inner pin 352 in second eyelet 34. Insulating sealing material 36 is composed of borosilicate glass. Each of outer pin 351 and inner pin 352 is a composite metal member including a copper core member 351*a*, 352*a* and a jacket member 351*b*, 352*b* composed of a Fe—Cr alloy. Copper core member 351*a*, 352*a* is exposed at a predetermined portion to provide a fuse element 37. Fuse element 37 is accommodated in the housing. Outer pin 351 and inner pin 352 are electrically connected via fuse element 37 disposed in the hermetic housing.

Hollow portion 31 is formed in each of first eyelet 33 and second eyelet 34 as shown in FIG. 5. The conductive pin is constituted of one pair of outer pin 351 sealed in first eyelet 33 and inner pin 352 sealed in second eyelet 34.

A terminal plate 38 for connection with an interconnection as shown in FIG. 5 may be joined to a side surface of an end portion of the conductive pin. The center axis of through hole 32*a* of first eyelet 33 may be deviated from the center axis of through hole 32*b* of second eyelet 34. The axis of outer pin 351 extending through through hole 32*a* of first eyelet 33 is deviated from the axis of inner pin 352 extending through through hole 32*b* of second eyelet 34, whereby outer pin 351 and inner pin 352 do not overlap with each other in the upward/downward direction. Accordingly, even when the melting and removal take place at the inner pin 352 side, inner pin 352, which is pushed up, is not brought into contact with outer pin 351. In this way, inner pin 352 and outer pin 351 can be prevented from being electrically connected to each other again.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

INDUSTRIAL APPLICABILITY

The fuse-equipped hermetic terminal according to the present invention is useful as a type of hermetic terminal for a large amount of current. Particularly, the fuse-equipped hermetic terminal according to the present invention is suitable as a hermetic terminal that supplies a signal and power to an electric device stored in a hermetic container. For example, the fuse-equipped hermetic terminal according to the present invention can be used for a hermetic terminal of a motor unit of a compressor such as one in a refrigerator or air conditioner.

REFERENCE SIGNS LIST

10, 20, 30: hermetic terminal; 11, 21, 31: hollow portion; 12*a*, 12*b*, 22*a*, 22*b*, 32*a*, 32*b*: through hole; 151, 251, 351: outer pin; 13, 23, 33: first eyelet; 152, 252, 352: inner pin; 14, 24, 34: second eyelet; 151*a*, 152*a*, 251*a*, 252*a*, 351*a*, 352*a*: core member; 151*b*, 152*b*, 251*b*, 252*b*, 351*b*, 352*b*: jacket member; 16, 26, 36: insulating sealing material; 17, 27, 37: fuse element; 18, 28, 38: terminal plate.

The invention claimed is:

1. A fuse-equipped hermetic terminal comprising:

a housing provided with a hollow portion and a pair of through holes located with the hollow portion being interposed therebetween;

a conductive pin extending through the housing via the pair of through holes and the hollow portion; and a pair of insulating sealing materials that each hermetically seal a gap between the conductive pin and a corresponding one of the pair of through holes, wherein:

the conductive pin includes an inner pin, an outer pin, and a fuse element that bridges between the inner pin and the outer pin and that is located in the hollow portion, center axes of the pair of through holes are offset from each other out of axial alignment, and the inner pin and the outer pin respectively extend through the through holes on opposite sides of the hollow portion, and respectively extend outwardly from the housing on opposite sides of the housing.

2. The fuse-equipped hermetic terminal according to claim 1, wherein the housing includes a first eyelet and a second eyelet, at least a portion of the hollow portion being provided in the first eyelet, the second eyelet being sealed with the first eyelet, the first eyelet is provided with one of the pair of through holes, and the second eyelet is provided with the other of the pair of through holes.

3. The fuse-equipped hermetic terminal according to claim 2, wherein a portion of the hollow portion is provided in the first eyelet, and another portion of the hollow portion is provided in the second eyelet.

4. The fuse-equipped hermetic terminal according to claim 1, wherein at least a portion of the conductive pin is constituted of a composite metal member including a core member and a jacket member.

5. The fuse-equipped hermetic terminal according to claim 4, wherein the core member is composed of a fusible metal material, and the fuse element of the conductive pin is constituted of the core member exposed through the jacket member.

6. The fuse-equipped hermetic terminal according to claim 1, wherein electric resistances of the outer pin and the inner pin are different from each other.

7. The fuse-equipped hermetic terminal according to claim 1, wherein the fuse element is composed of a fusible metal material selected from a group consisting of a solder alloy, copper, a copper alloy, aluminum, an aluminum alloy, silver, and a silver alloy.

8. The fuse-equipped hermetic terminal according to claim 1, wherein the fuse element is received and arranged only in the hollow portion, and does not extend into or through the through holes of the housing.

9. The fuse-equipped hermetic terminal according to claim 1, wherein the inner pin and the outer pin respectively extend entirely through the through holes of the housing and into the hollow portion within the housing.

10. The fuse-equipped hermetic terminal according to claim 1, wherein respective axes of the inner pin and the outer pin respectively extending through the through holes are offset from one another in a radial direction with respect to a central axis of the circular housing.

11. The fuse-equipped hermetic terminal according to claim 1, wherein respective axes of the inner pin and the outer pin respectively extending through the through holes are offset from one another in a rotational direction about a central axis of the circular housing.

12. A hermetic terminal comprising:

a housing that defines a hollow space therein and that comprises a first housing wall and a second housing wall which bound the hollow space therebetween, wherein a first opening penetrates through the first housing wall and a second opening penetrates through the second housing wall, and wherein respective center axes of the first and second openings are offset from one another out of axial alignment;

a first conductive pin that extends from the hollow space through the first opening out of the housing on a first side thereof;

a second conductive pin that extends from the hollow space through the second opening out of the housing on a second side thereof opposite the first side;

a first seal that hermetically seals the first conductive pin in the first opening;

a second seal that hermetically seals the second conductive pin in the second opening; and a fuse element that is disposed in the hollow space and electrically conductively connects between the first conductive pin and the second conductive pin;

wherein respective center axes of the first and second conductive pins are offset from one another out of axial alignment.

* * * * *